US005996855A

United States Patent [19]

Alexander et al.

[11] Patent Number: 5,996,855

[45] Date of Patent: Dec. 7, 1999

[54] CROSS-FEED AUGER AND METHOD

[75] Inventors: George R. Alexander, Frankton, Ind.; William H. Brown, West Chester, Ohio; Eduardo C. Escallon, Elwood, Ind.

[73] Assignee: Material Sciences Corporation, Elk Grove Village, Ill.

[21] Appl. No.: 09/032,021

[22] Filed: Feb. 27, 1998

[51] Int. Cl.[6] ..... B65D 88/54

[52] U.S. Cl. ..... 222/318; 222/412; 118/621

[58] Field of Search ..... 222/318, 410, 222/412, 414, 238; 118/621, 627, 308; 425/147

[56] References Cited

U.S. PATENT DOCUMENTS

| | | | |
|---|---|---|---|
| 2,957,608 | 10/1960 | Wahl | 222/161 |
| 3,104,035 | 9/1963 | McKinney | 222/185 |
| 3,327,903 | 6/1967 | Waller | 222/227 |
| 3,386,416 | 6/1968 | Wirth | 222/414 |
| 4,041,901 | 8/1977 | Rarey et al. | 118/621 |
| 4,349,323 | 9/1982 | Furbish et al. | 425/147 |
| 4,559,104 | 12/1985 | Eriksson | 162/336 |
| 4,726,715 | 2/1988 | Steen et al. | 406/55 |
| 4,790,457 | 12/1988 | Morse et al. | 222/185 |
| 4,860,928 | 8/1989 | Shimazu | 222/167 |
| 5,139,176 | 8/1992 | Reindl et al. | 222/238 |
| 5,152,433 | 10/1992 | Mohri | 222/152 |
| 5,240,185 | 8/1993 | Kaiju | 239/690 |
| 5,314,090 | 5/1994 | Alexander | 222/1 |
| 5,769,276 | 6/1998 | Alexander | 222/410 |

*Primary Examiner*—P. Derakshani
*Attorney, Agent, or Firm*—Liniak, Berenato, Longacre & White, LLC

[57] ABSTRACT

A method and system for maintaining a uniform volume of powder in a powder feeder provided. The system includes a supply hopper that is spared from a powder feeder. The powder includes a receiving opening and a discharge opening. A rotatable brush is in communication with the supply hopper for causing powder withdrawn from the supply hopper to be transported to the powder feeder and disposed uniformly across the receiving opening of the powder feeder. The brush is immersed within the powder and extends across the receiving opening of the powder feeder, and maintains a filled level powder feeder.

21 Claims, 5 Drawing Sheets

CROSS-FEED AUGER AND METHOD

FIELD OF THE INVENTION

The present invention relates to an apparatus and method for maintaining a powder feeder uniformly filled with a volume of particulate material to be dispensed for coating a continuous substrate or discrete articles. More particularly, the invention is directed to a cross feed auger formed by a horizontally disposed rotatable brush within the inlet of a powder feeder, for causing powder to be deposited into the feeder for ultimate application by an electrostatic coater onto a substrate.

BACKGROUND OF THE INVENTION

Electrostatic coating processes have been used to modify the surface characteristics of a substrate. In order to coat the substrate, a powder atomizer is combined with a feeder to deliver measured amounts of powder into an air stream. The air stream is directed to a coating apparatus, which electrically charges the powder particles so that they become attracted to the substrate. The powder is sometimes chemically highly reactive, and typically small in size. Strong electrostatic forces charge the powder particles and thereby cause them to be attached to the substrate. The substrate frequently is in continuous strip or web form, and advances continuously across through the coating apparatus.

Electrostatic forces can be extremely strong on small particles, equaling perhaps 10 to 1000 times their weight. The electrode is often placed 4 to 6 inches away from the substrate to permit the vast majority of the generated powder cloud to be diffused within that bound and thus beneficially influenced by the electrostatic effects. These include the electric field, ions created by the corona discharge energetically propelled by that field toward the strip, charge transfer by some of these ions colliding with the interspersed powder, and collision and momentum transfer between the energetic ions and the interspersed powder.

The powder dispensed from the powder feeder must be dispensed at uniform rates of flow, otherwise discontinuities or lack of uniformity may develop in the coating. The height of the powder within the powder feeder should be kept level, in order to maintain a uniform head pressure at the feeder inlet. Should the substrate be disposed above the powder feeder inlet, then the substrate cannot be more widely spaced therefrom because of the electrode placement. Maintaining and controlling the volume of powder within the powder feeder has been difficult because of the resulting limited and available height between the substrate and the feeder.

In order to evenly distribute the powder onto the substrate, the powder should be evenly distributed across the powder feeder. The discharge rate is determined by the amount of powder that must be provided per unit time to coat the substrate throughout its width to the desired thickness. Should the powder be non-uniformly distributed within the powder feeder, then the discharge rate from the powder feeder discharge will not be uniform. Non-uniform powder discharge from the feeder will result in discontinuous or non-uniform coatings. Thus, there is need in the art for an apparatus and method which functions to maintain a constant volume of powder throughout a powder feeder during operation of the electrostatic powder coater.

The inventors' attempts to solve the problem included shaking, blowing, levitating, and pushing the powder into the feeder. Shaking the powder along a transport path is disadvantageous, because an appropriate angle can not be achieved for adequate feeding of the powder along the range of discharge rates required to be attained and the strong tendency to agglomerate the powder. Blowing the powder into the powder feeder caused control over the amount of powder fed to the powder feeder to be lost, with the powder being non-uniformly distributed. Pushing the powder into the powder feeder may cause reactive powder to begin to onset chemical changes, so that the powder will agglomerate or sinter prior to discharge and/or prior to application to the substrate. The inventors also attempted to use a fluidization method to levitate powder in a slightly inclined trough through which the powder would flow laterally. This was not successful because of the required inclination angle, and the inability to place the powder uniformly across the relatively wide brush feeder hopper. Thus, there is a need in the art for an apparatus and method for maintaining a power feeder uniformly filled, while minimizing the tendency of the powder to react.

SUMMARY OF THE INVENTION

An apparatus for communicating powder from a supply hopper to a powder feeder includes a supply hopper, and a powder feeder having an inlet and a discharge. The powder feeder is spaced from the supply hopper. A rotatable brush is in communication with the supply hopper, for causing powder to be withdrawn from the supply hopper and to be transported horizontally to the powder feeder. The powder is dispensed uniformly by rotation of the brush across the inlet of the powder feeder. The rotatable brush is disposed within and extends across the inlet of the powder feeder. A motor is provided for rotating the brush.

An apparatus for communicating powder from a supply hopper to a plurality of powder feeders includes a supply hopper, and first and second powder feeders. Each powder feeder has an inlet and a discharge opening, and is spaced from the supply hopper. First and second horizontally disposed rotating brushes are provided. Each brush is in communication with the supply hopper for causing powder to be withdrawn from the supply hopper and to be transported to the first and second powder feeders. The powder is dispensed uniformly across the inlets of the powder feeders. The brushes are disposed in parallel and are vertically spaced. A drive is provided for rotating the first and second brushes.

A method for maintaining a powder feeder uniformly filled includes the steps of disposing a rotating brush horizontally within and coextensive with the inlet of a powder feeder. The brush is rotated, thereby causing powder to be withdrawn from the hopper and transported longitudinally into the feeder. Powder is deposited by the rotating auger brush through an inlet into the feeder and allowed to exit in small quantities from an outlet of the feeder, thereby maintaining the powder feeder uniformly filled.

These and other objects of the present invention will be become apparent from following detailed description of the preferred embodiment.

BRIEF DESCRIPTION OF THE DRAWINGS

Other features and advantages of this invention will become apparent in the following detailed description of the preferred embodiment of this intention with reference to the accompanying drawings, in which.

DETAILED DESCRIPTION OF THE PREFERRED EMBODIMENT

Figure 1:
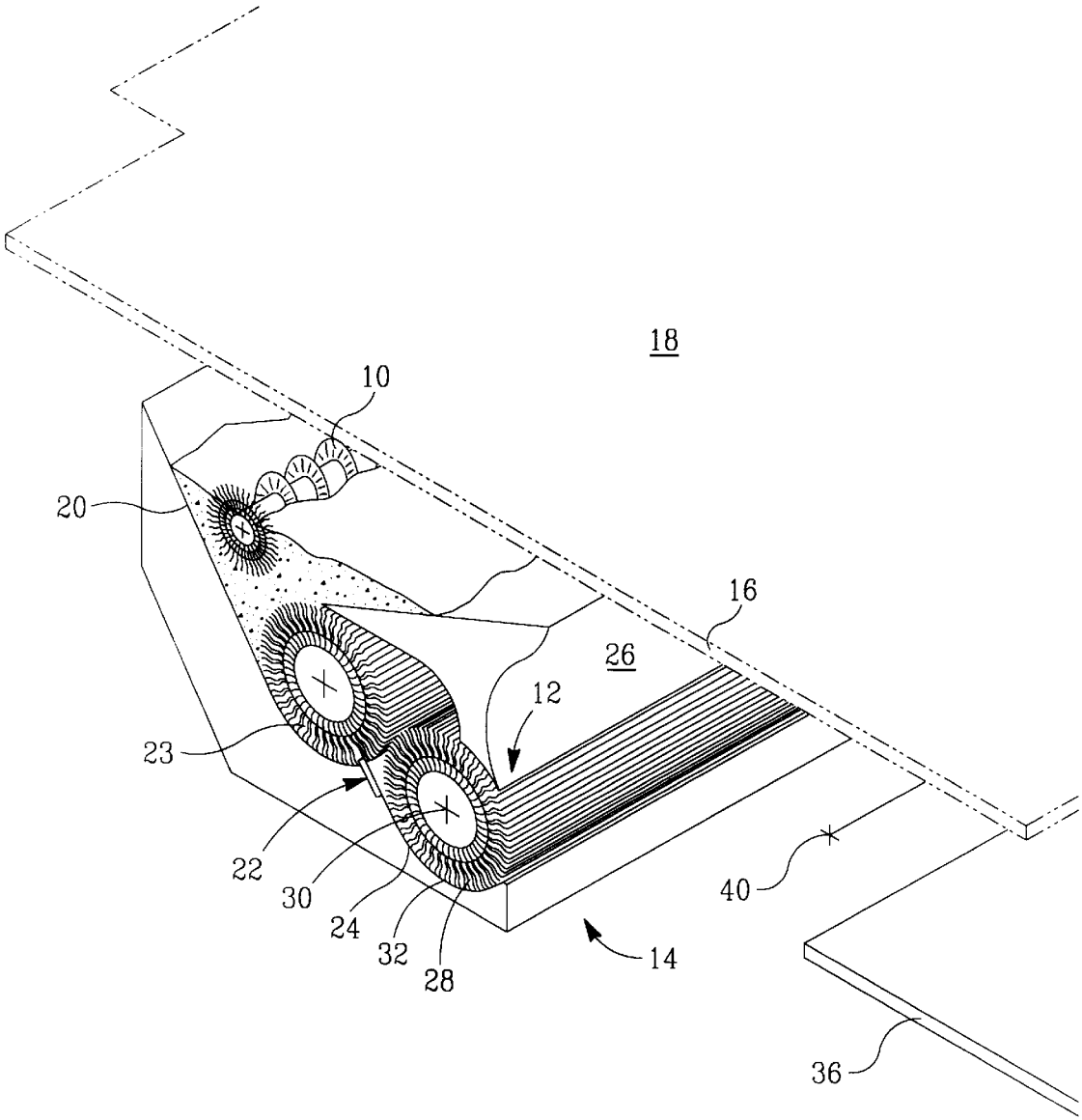
FIG. 1 is a fragmentary perspective view of an electrostatic coating apparatus with the cross feed auger of the present invention.
Figure 2:
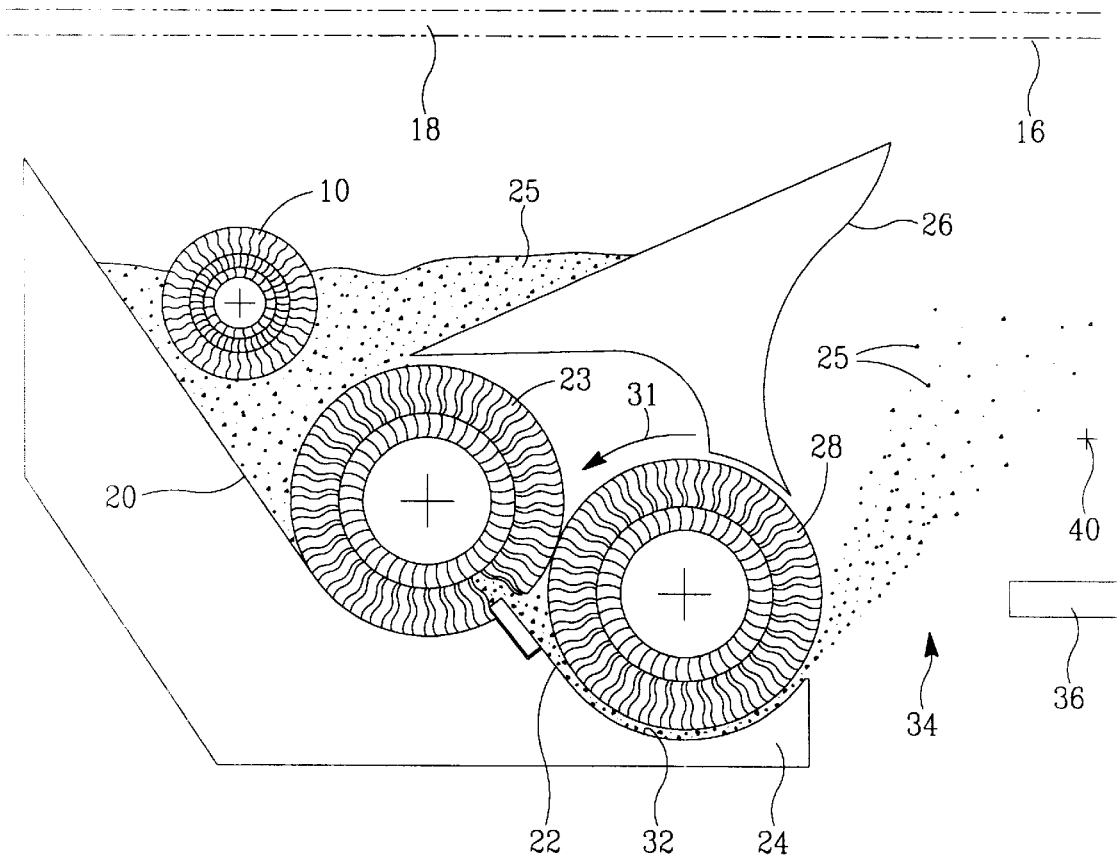
FIG. 2 is an elevational view of the apparatus illustrated in FIG. 1.

As best shown in FIGS. 1 and 2, rotatable brush 10 is immersed in powder disposed within powder atomizer 12 of a wide web powder coating apparatus 14. Powder atomizer 12 causes particulates, such as thermoset, thermoplastic, and other finely divided material, to be electrostatically applied to bottom surface 16 of continuously moving substrate 18. The apparatus 12 includes a powder feeder 20 with a discharge 22, through which powder is communicated by metering brush 23 to atomizer brush 28 for application ultimately onto substrate 18.

Powder atomizer 12 includes a pan 24, a wing 26, and an atomizing brush 28. Brush 28 is journaled for rotation in the direction of arrow 31 about a generally horizontal axis 30. Brush 28 and pan 24 are spaced in order to define a venturi 32 therebetween, into which powder is fed from powder feeder 20.

In operation, the powder feeder 20 feeds powder to the atomizer 12 through venturi 32. As the brush 28 rotates and deagglomerates the powder, the powder is directed and aimed by wing 26 into the area of entrance 34 of an electrostatic coater 36. The powder is dispersed by 28 as a flowing cloud. Once the cloud is received within the area of the entrance 34 of electrostatic coater 36, the cloud will be under the influence of the electrical field and ionization of the electrodes 40 of the coater 36. Thus, the charged powder particles are caused to move by electrostatic attraction to the grounded strip 18.

While this invention will be described as it is used with a specific electrostatic coating process, it should be understood that it might be used with other electrostatic coating systems. In addition, the present invention may be used in any coating operation where a uniform volume of a powder feeder is required and where the powder is highly reactive. An example of alternative electrostatic coating processes is disclosed in U.S. Pat. No. 5,314,090, which is hereby incorporated by reference.

Figure 3:
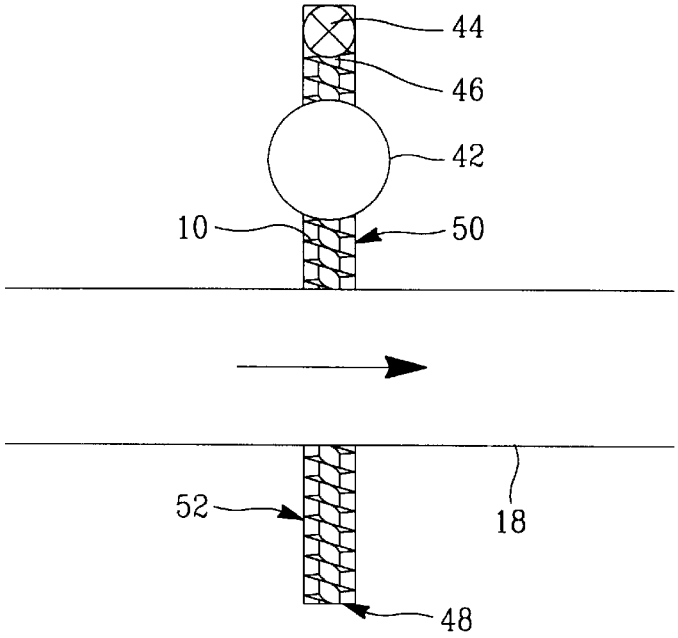
FIG. 3 is a top plan view of the cross feed auger of the present invention.
Figure 4:
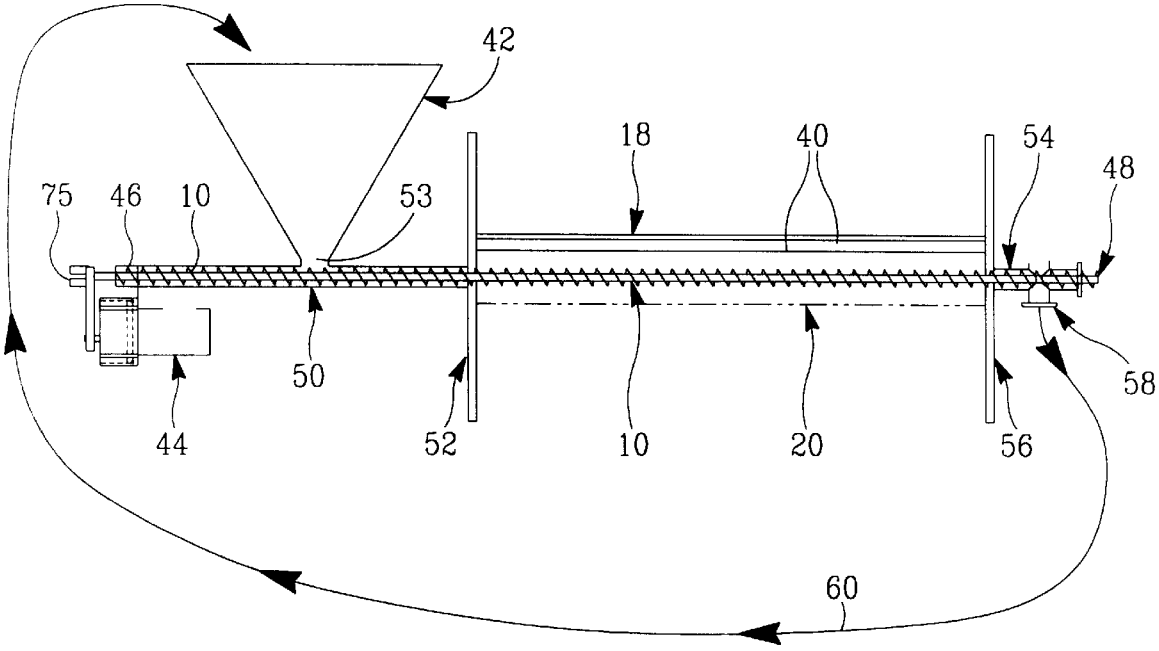
FIG. 4 is a side elevational view of a first embodiment of the cross feed auger of the invention.

In order to obtain a uniformly coated substrate, powder should be uniformly discharged by rotatable brush 23 across its length toward passage 22. Rotatable brush 10 is immersed within powder and extends at least the length of the powder feeder 20 in order to maintain a horizonally supply of particulates 25 therein. The feeder 20 has a limited volume, and its powder must be replenished as the powder is withdrawn by brush 23. Because of the limited space between the substrate 18 and the powder feeder 20, a supply hopper for powder particulates may not be positioned conveniently between the substrate 18 and the powder feeder 20 in order to permit replenishment of powder in feeder 20. Horizontally disposed rotatable brush 10 transports powder from supply hopper 42 to powder feeder 20, as best shown in FIGS. 3 and 4.

Rotatable brush 10 is in the form of a screw conveyor, so that powder is moved from the supply hopper 42 to the powder feeder 20. In order to vary the flow of powder from the supply hopper 42 to the powder feeder 20, the auger speed may be varied, with normal operation causing brush 10 to rotate at about 100 RPM for a 2-inch diameter brush 10. The rotational speed and brush diameter should each be as small as possible in order to minimize shear forces on the powder particles. Additionally, the pitch of the flights of the bristles of the brush 10 may also be increased to increase the flow of powder transported by brush 10 at a given speed. The brush 10 rotates continuously in order to maintain the powder feeder 20 filled. The powder carrying capacity of brush 10 is proportional to its pitch times the speed of rotation times its diameter. Because of the softness, flexibility, and small bristle size, low shear forces are imposed on the powder at the bristle/housing interface. The rotatable brush 10 is made from bristles, which are of a suitable length and spatial density to sweep the powder from supply hopper 42 to the powder feeder 20.

Rotatable brush 10 includes proximal end 46 journaled to electric motor 44, and a distal end 48 which extends laterally beyond the powder feeder 20. Brush 10 is exteriorly fixed at proximal end 46, and is supported at end 48 by second tube 54. First tube 50 extends from proximal end 46 to the entrance wall 52 of the coater 36, and surrounds and encloses a first length of brush 10. Tube 50 includes an aperture 53, from which powder is fed from the supply hopper 42. Supply hopper 42 is spaced from open proximal end 46 a distance sufficient to preclude spilling of the powder due to its angle of repose.

Brush 10 is coextensive with and immersed within the powder filling the powder feeder 20. Powder is dispensed throughout the length of the powder feeder 20. As brush 10 rotates, powder is withdrawn from hopper 42 and advanced longitudinally between the flights of the bristles of brush 10. As the powder advances beyond wall 52, then it is disposed in the top of feeder 20, and may fall into feeder 20 should there be available space. The powder will fall into the first available location within feeder 20, ultimately causing all void spaces to fill. Preferably about 5% to about 10% powder in excess of that required to maintain feeder 20 filled is supplied to brush 10, in order to make certain that the feeder 20 is filled level between its opposite end walls 52 and 56. Upon initial operation, powder will first fill the feeder 20 adjacent wall 52, taking into account the angle of repose of the powder, and will continue to fill feeder 20 in the direction of end wall 56. Thus, powder is evenly distributed throughout the powder feeder 20 insuring a uniform head pressure on rotatable brush 23 to permit a uniform coating to be applied to substrate 18. Should an excess of powder not be supplied, then the feeder 20 at the end wall 56 will not maintain its head pressure. The flow rate through rotatable brush 23 will as a result decrease, causing a thinner deposition on substrate 18 in that region.

Rotatable brush 10 is surrounded at its distal end by second tube 54. Second tube 54 extends from opposite exit wall 56 of the coater 36 to distail end 48. The tube 54 allows the necessary excess particulates to be transported beyond powder feeder 20 when powder feeder be filled. Second tube 54 and distal end 48 extend a distarce from exit wall 56. Reclaim port 58 communicates with tube 54 and returns excess powder to supply hopper 42 through path 60. A Doppler microwave frequency device, such as an Endress and Hauser Model DTR 131Z, insures that excess powder is being fed through powder feeder 20 at all times. Excess powder may be recycled back to supply hopper 42, increasing the powder utilization of the system.

The speed at which the brush 10 rotates is coordinated with the speed at which the brush 23 is rotated, such that continuous and adequate powder flows from the brush 10, to powder feeder 20, and from atomizer 12 to coater 36.

Figure 5:
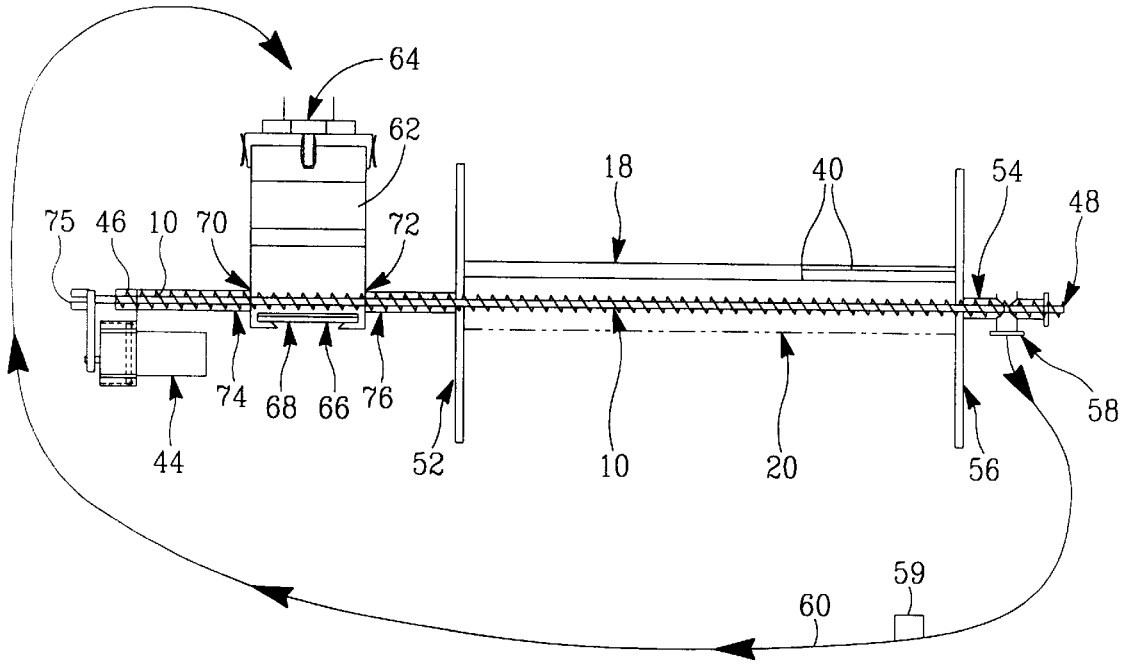
FIG. 5 is a side elevational view of a second embodiment of the cross feed auger of the invention.

Powder paints are typically used to coat the surface of metal substrates. The powders may be thermoset resins, which react with only minimal energy input. However, it should be understood that the invention is not limited to the coating of metal substrates with thermoset resins. For instance, the present invention may be used for thermoplastic nylon deposition, cornstarch deposition to paper articles, and the like. While this invention has been described is used with a specific electrostatic coating process, it may be used in any coating operation where a level volume of a powder feeder 20 is required, or where the powder is highly reactive. In the embodiment of FIGS. 3 and 4, the supply hopper 42 is conical in shape, and feeds powder through opening 53 of first tube 50. Alternatively, as best shown in FIG. 5, the supply hopper 62 may be rectangular in shape. FIG. 5 discloses an embodiment similar to that of FIGS. 1–4, so like numbers refer to like components. The powder is loaded into hopper 62 through opening 64. Along bottom surface 66 is air plenum 68, which bubbles fluid, such as air bubbles or inert gas, through the supply hopper 62 like in a fluidized bed. Air plenum 68 prevents the powder at the bottom of the feeder 63 from packing or bridging. Air plenum 68 fluidizes the powder in the lower auger region of hopper 62, and thus enables the powder to flow more readily into the brush or auger 10 without introducing high shear forces. The plenum 68 may have several fluidizing sections along its length, so that different air flows may be applied to insure satisfactory filling of brush 10 without creating rat holes which detract from fluidization. Additionally, the pitch of auger brush 10 in the region of hopper 62 may be locally varied to promote uniform lateral filling The supply hopper 62 includes a first aperture 70 and a second aperture 72, with brush 10 extending therethrough. Tube 74 surrounds rotatable brush 10 between its open proximal end 46 and aperture 70. Tube 76 surrounds the brush 10 from aperture 72 to chamber wall 52. Tube 74 is of sufficient length to preclude the powder from spilling out its open end. Auger brush 10 is supported for rotation by exterior bearings 75.

Figure 6:
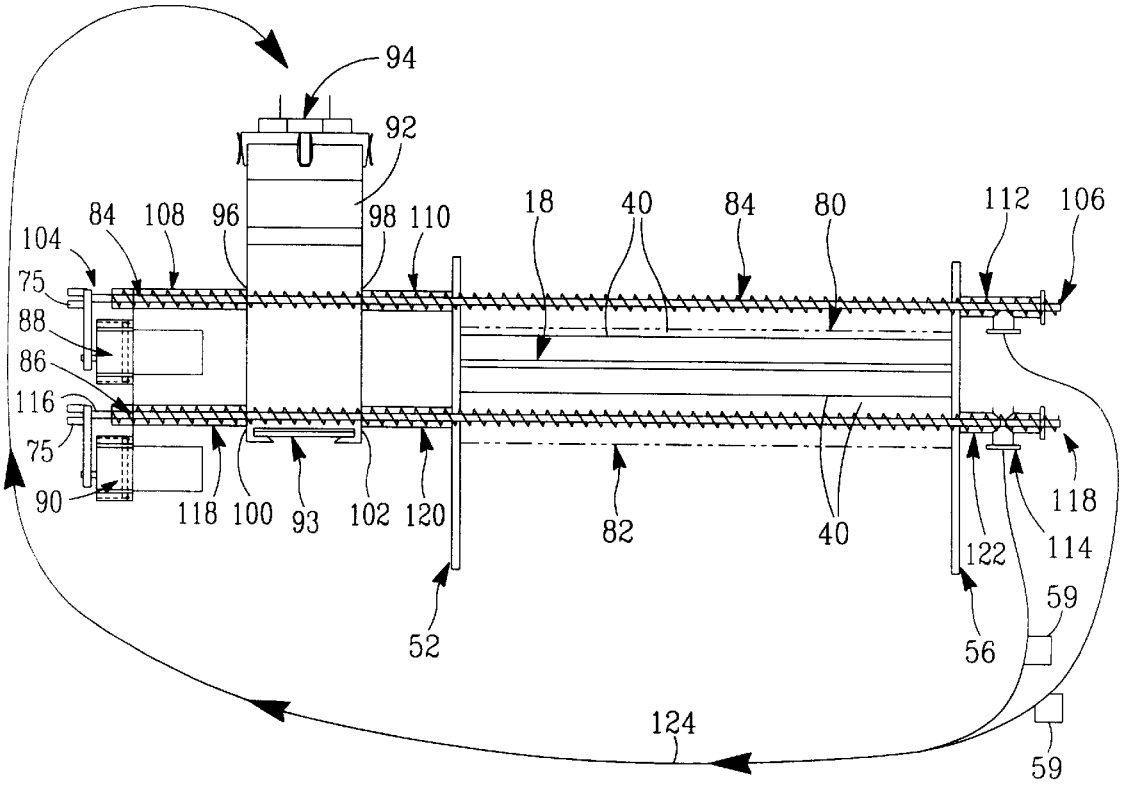
FIG. 6 is a side elevational view of a third embodiment of the present invention for electrostatically coating the top and bottom surfaces of a substrate.

Two coaters A and B are provided, one disposed above substrate 18 and the other disposed below substrate 18, as best shown in FIG. 6. The coaters A and B include powder feeders 80 and 82, rotatable auger brushes 84 and 86, and motors 88 and 90 to drive each auger brush 84 and 86, respectively. Supply hopper 92, with hopper inlet 94, supplies powder to both powder feeders 80 and 82 through rotatable brushes 84 and 86, respectively. Supply hopper 92 includes four apertures 96, 98, 100 and 102. Apertures 96 and 98 are horizontally aligned, at opposite walls of supply hopper 92. Likewise apertures 100 and 102 are horizontally aligned at opposite walls of supply hopper 92. Apertures 96 and 98 permit rotatable brush 84 to extend through hopper 92, so that powder may be transported from the supply hopper 92 to the powder feeder 80. Likewise, apertures 100 and 102 provide an opening through which rotatable brush 86 extends, thereby permitting powder to be transported from the supply hopper 92 to the powder feeder 82.

Brush 84 includes an open proximal end 104, which is supported by bearings 75 and journaled to variable speed motor 88, and a distal end 106, which usually is supported by a surrounding tube. Brush 84 is surrounded by tube 108 from proximal end 104 to aperture 96 supply hopper 92. Tube 108 is of a length sufficient to prevent powder from spilling out its open end due to the angle of repose of the powder. Rotatable brush 84 is surrounded by tube 110, which extends from the aperture 98 of supply hopper 92 to the chamber wall 52. Rotatable brush 84 extends through and is coextensive with powder feeder 80. Rotatable brush 84 is surrounded by tube 112, which extends from chamber wall 56 to distal portion 106. Tube 122 is as short as possible, in order to prevent unneeded working of the powder. Reclaim port 114 communicates with tube 112, and redirects powder to the supply hopper 92. Operation of Doppler sensors 59 assure that some excess powder is fed at all times. Preferably, air plenum 93 percolates gas bubbles through the powder in hopper 92 to prevent bridging and packing, which can cause clumping and agglomeration of the powder.

Rotatable brush 86 includes an open proximal end 116, which is supported by exterior bearings 75 and journaled to variable speed motor 90, and a distal end 118, which is normally unsupported. Rotatable brush 86 is surrounded by tube 118, which extends from proximal end 116 to aperture 100 of supply hopper 92. Rotatable brush 84 is surrounded by tube 120 which extends from aperture 102 of supply hopper 92 to chamber wall 52. Tube 118 is of a length sufficient to preclude powder released into the tube 118 from spilling out its open end. Rotatable brush 86 extends above and is coextensive with the inlet of powder feeder 82. Rotatable brush is surrounded by tube 122, which extends from the chamber wall 56 to distal end 118. Reclaim port 114 communicates with Doppler sensor 59, and redirects powder from top tube 112 and bottom tube 122 to the supply hopper 92, through a path 124.

The cross feed auger brushes 84 and 86 permit the top and bottom surfaces of substrate 18 to be coated uniformly, while maintaining a level, thus uniform supply of powder in the powder feeders 80 and 82. Thus, as powder is dispensed from powder feeders 80 and 82, the powder is charged by electrodes to evenly coat the top and bottom surfaces of substrate 18. At the same time, brushes 84 and 86 rotate in order to withdraw powder from hopper 92 so that same may be used to replenish feeders 80 and 82.

Figure 7:
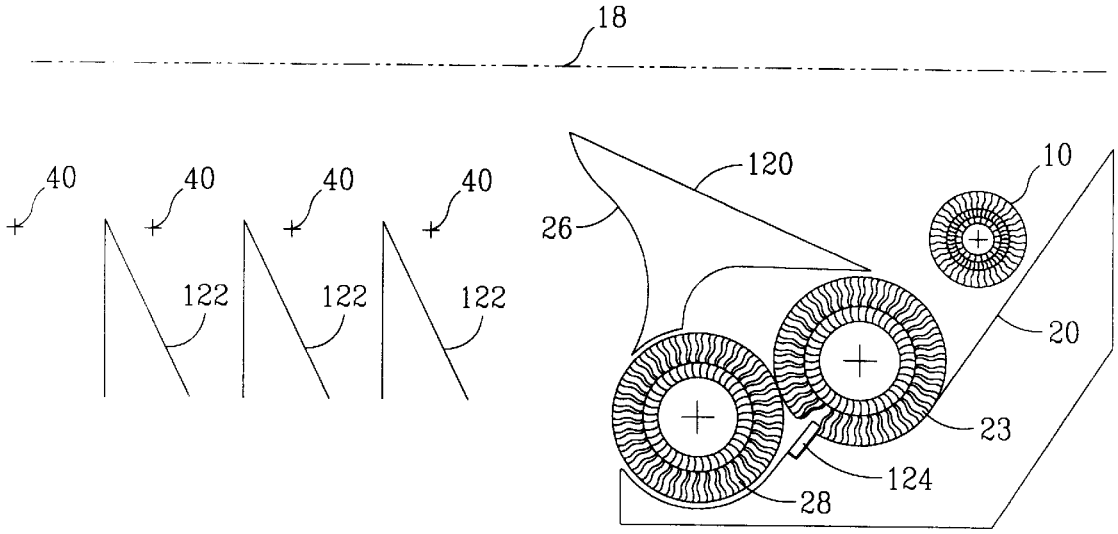
FIG. 7 is a fragmentary cross-sectional view of the first embodiment

FIG. 7 is a fragmentary cross-sectional view according to FIG. 1, with like reference numerals designating like components. Preferably wing 26 has an upper surface 120 forming a forward surface of powder feeder 20. Wing 26 is curved in order to direct the powder toward the electrodes 40 and substrate 18. Non-conductive baffles 122 are interposed between electrodes 40, in order to shape the cloud of particles and the electric field, so that the charged powder is very efficiently applied to the substrate 18. The electrodes 40 and baffles 122 extend the width of the substrate 18, so that powder is applied over the total exposed surface.

Cleaner 124, which may be another brush, extends the length of metering brush 23. Cleaner 124 extends inwardly into the bristles of metering brush 23, in order to open the bristles and allow any remaining powder to fall therefrom. Thus, as the metering brush 23 rotates toward the feeder 20, then its bristles will be virtually empty, and ready to receive a uniform supply of powder throughout its length. Uniform application of powder to substrate 18 is best done with a horizontally level supply of powder 25 carried by metering brush 23 in the region 24 for transfer to atomizing brush 28.

While this invention has been described as having a preferred design, it is understood that it is capable of further modifications, uses, and/or adaptations thereof following in general the principles of the invention including such departures that have been within known or customary practice in the art to which the invention pertains.

What we claim is:

1. An apparatus for communicating powder from a supply hopper to a powder feeder in order to maintain the feeder filled, comprising:

a) a supply hopper;

b) a powder feeder having an inlet and a discharge, said powder feeder spaced from said supply hopper;

c) a rotatable brush in communication with said supply hopper and extending across said inlet for causing powder to be withdrawn from said supply hopper and to be transported longitudinally along the rotatable brush to said powder feeder and to be dispensed uniformly across said powder feeder through said inlet, and d) a drive for rotating said brush.

2. The apparatus of claim 1, wherein:

a) said brush is horizontally disposed.

3. The apparatus of claim 2, wherein:

a) said brush includes proximal and distal ends, said proximal end secured to said drive.

4. The apparatus of claim 3, wherein:

a) said distal end extends beyond said inlet a distance sufficient to prevent the powder from spilling.

5. The apparatus of claim 4, further comprising:

a) a reclaim port disposed adjacent to said distal end, said reclaim port in communication with said supply hopper for redirecting powder thereto.

6. The apparatus of claim 1, wherein:

a) said drive is a motor.

7. The apparatus of claim 1, wherein:

a) said brush including a plurality of bristles, said bristles having a thickness substantially that of the diameter of the powder particles.

8. The apparatus of claim 1, further comprising:

a) an air plenum is disposed within said supply hopper for percolating fluid through said hopper.

9. The apparatus of claim 1, wherein:

a) said brush is fixed only at said drive.

10. An apparatus for communicating powder from a supply hopper to a powder feeder, comprising:

a) a supply hopper;

b) first and second powder feeders, each feeder having an inlet and a discharge, and said powder feeders spaced from said supply hopper;

c) first and second horizontally disposed rotatable brushes, each brush disposed above and extending along one of said feeders and said brushes extending in vertically spaced parallel relation, said brushes in communication with said supply hopper for causing powder to be withdrawn from said supply hopper and to be transported longitudinally along said rotatable brushes to said first and second powder feeders, and to be dispensed uniformly across said powder feeders; and d) a drive system for rotating said first and second brushes.

11. The apparatus of claim 10 wherein:

a) said brushes each including proximal and distal ends, said proximal ends secured to said drive system.

12. The apparatus of claim 11, wherein:

a) said distal ends extend beyond said inlets a distance sufficient to prevent the powder from spilling out.

13. The apparatus of claim 12, further comprising:

a) a reclaim port communicates with said distal ends for redirecting powder to said hopper.

14. The apparatus of claim 10, wherein:

a) said drive is a motor.

15. The apparatus of claim 10, wherein:

a) said brushes include a plurality of bristles disposed helically in flights.

16. The apparatus of claim 10, further comprising:

a) an air plenum is disposed with in said supply hopper for percolating fluid through said hopper.

17. The apparatus of claim 10, where in:

a) said first and second brushes are each fixed only at said drive system.

18. A method for maintaining a uniformly filled powder feeder, comprising the steps of:

a) supplying powder to a rotatable brush horizontally immersed within and coextensive with a powder feeder;

b) rotating the brush and thereby causing powder to be withdrawn from a hopper and transported longitudinally along the rotatable brush into the feeder; and c) permitting powder from the brush to fall therefrom in order to fill the feeder.

19. The method of claim 18, including the step of:

a) recycling powder to the supply hopper.

20. The method of claim 18, including the step of:

a) percolating fluid through the hopper to prevent packing or bridging of the powder.

21. A powder application system, comprising:

a) a powder feeder atomizer comprising a supply hopper, a powder feeder having an inlet and a discharge and said powder feeder spaced from said supply hopper, a rotatable auger brush in communication with said supply hopper and extending across said inlet for causing powder to be withdrawn from said supply hopper and to be transported longitudinally to said powder feeder and to be dispensed level across said powder feeder through said inlet, and a drive for rotating said brush;

b) an application chamber in communication with said powder feeder atomizer, said application chamber having a substrate inlet aligned with a substrate exit, a plurality of charging electrodes arrayed in said chamber for charging powder supplied by said powder feeder atomizer, and a plurality of baffles disposed within said chamber interposed with said electrodes for shaping the cloud of powder and the electric field resulting from said electrodes so that powder is attracted to and caused to be attached to substrate disposed within said chamber.

* * * * *